US007459646B1

(12) United States Patent
Shi

(10) Patent No.: US 7,459,646 B1
(45) Date of Patent: Dec. 2, 2008

(54) KEYPAD ASSEMBLY AND PORTABLE ELECTRONIC DEVICE WITH SAME

(75) Inventor: Zheng Shi, Shenzhen (CN)

(73) Assignees: Shenzhen Futaihong Precision Industry Co., Ltd., ShenZhen, Guangdong Province (CN); Sutech Trading Limited, Tortola (VG)

( * ) Notice: Subject to any disclaimer, the term of this patent is extended or adjusted under 35 U.S.C. 154(b) by 0 days.

(21) Appl. No.: 11/952,958

(22) Filed: Dec. 7, 2007

(30) Foreign Application Priority Data

May 25, 2007 (CN) ..... 2007 1 0074588

(51) Int. Cl.
*H01H 9/00* (2006.01)

(52) U.S. Cl. ..... 200/5 R

(58) Field of Classification Search ..... 200/4, 200/5 R, 6 A, 17 R, 18, 329; 340/20, 22, 340/35; 345/156, 157, 160–163, 168, 169, 345/184; 74/470, 471; 273/148 B; 463/36–38
See application file for complete search history.

(56) References Cited

U.S. PATENT DOCUMENTS

| | | | | |
|---|---|---|---|---|
| 6,753,848 | B2 * | 6/2004 | Toshiharu | 345/157 |
| 7,060,915 | B2 * | 6/2006 | Bricaud et al. | 200/5 R |
| 7,068,259 | B2 * | 6/2006 | Kim et al. | 345/169 |
| 7,081,883 | B2 * | 7/2006 | Chen | 345/163 |
| 7,158,115 | B2 * | 1/2007 | Harley et al. | 345/157 |
| 7,193,166 | B2 * | 3/2007 | Sakurai | 200/5 R |
| 7,282,656 | B2 * | 10/2007 | Niiyama | 200/5 R |
| 7,294,795 | B1 * | 11/2007 | Kondo et al. | 200/5 R |
| 7,310,083 | B2 * | 12/2007 | Hagiwara et al. | 345/156 |
| 7,310,084 | B2 * | 12/2007 | Shitanaka et al. | 345/156 |

* cited by examiner

*Primary Examiner*—Michael A Friedhofer
(74) *Attorney, Agent, or Firm*—Steven M. Reiss

(57) ABSTRACT

A keypad assembly (10) for use in a portable electronic device (8), includes a housing (14) and a key (12). The housing is substantially a flat board, and defines a recess and a hole (143, 145) therein. The key is mounted in the recess and the hole and is defined as in an original state when it is not operated. The key is capable of moving in different directions relative to the housing when it is manually operated. The key is defined as in an operational state when it is manually moved.

14 Claims, 5 Drawing Sheets

KEYPAD ASSEMBLY AND PORTABLE ELECTRONIC DEVICE WITH SAME

BACKGROUND OF THE INVENTION

1. Field of the Invention

The present invention generally relates to keypad assemblies and, particularly, to a keypad assembly of a portable electronic device, such as a mobile telephone, an electronic notebook, and the same.

2. Description of Related Art

With the development of wireless communication and information processing technologies, portable electronic devices, such as mobile telephones and personal digital assistants (PDAs), are now in widespread use. These portable electronic devices enable consumers to enjoy high technology services, anytime and anywhere. A keypad assembly of an input terminal has been an indispensable member of the portable electronic device.

A typical keypad assembly is used with a printed circuit board of a given portable electronic device. Several fixed switchpoints are formed on the printed circuit board and several keys are respectively disposed above the fixed switchpoints, with elastic members formed therebetween. In use, the key is pressed downward, overcoming the elastic force, to make contact with a corresponding switchpoint, thereby generating an input signal.

Generally, there are a plurality of characters printed on a key surface indicating that a user may input (or select) anyone of the characters via this key. If the user selects the first character, he/she needs to press the key once. If the user selects the second character, he/she needs to press the key twice. Similarly, if the user selects the fourth character, he/she needs to press the key up to four times. Thus, it is inconvenient for the user to input information.

Therefore, a new keypad assembly is desired in order to decrease the above-described inconvenience.

SUMMARY

In one aspect thereof, a keypad assembly for use in a portable electronic device, includes a housing and a key. The housing has an outer surface defining a recess therein. The key being is received in the recess. The key is defined in an original state when it is not being manually operated, and the key is defined in an operational state when it is manually operated to move in the recess in a direction parallel to the outer surface. The key is manually operative to move from the original state to the operational state, and to move back from the operational state to the original state when the operation on the key is released.

In another aspect thereof, a portable electronic device includes a keypad assembly and a substrate seat. The keypad assembly includes a housing and a key. The housing has an outer surface defining a recess therein. The key being is received in the recess. The key is defined in an original state when it is not being manually operated, and the key is defined in an operational state when it is manually operated to move in the recess in a direction parallel to the outer surface. The substrate seat has at least one switchpoint. The housing is mounted to the substrate seat. The key is manually operative to move from the original state to the operational state to abut the switchpoint, and to move back from the operational state to the original state when the operation on the key is released.

Other advantages and novel features of the embodiments will become more apparent from the following detailed description thereof, when taken in conjunction with the accompanying drawings.

BRIEF DESCRIPTION OF THE DRAWINGS

Many aspects of the present keypad assembly can be better understood with reference to the following drawings. The components in the drawings are not necessarily drawn to scale, the emphasis instead being placed upon clearly illustrating the principles of the present keypad assembly and its potential applications. Moreover, in the drawings, like reference numerals designate corresponding parts throughout the several views.

DETAILED DESCRIPTION OF THE EMBODIMENTS

The present keypad assembly is suitable for portable electronic devices, such as mobile phones, PDAs, and the like. Other applications with similar keypad employed can also be found.

Figure 1:
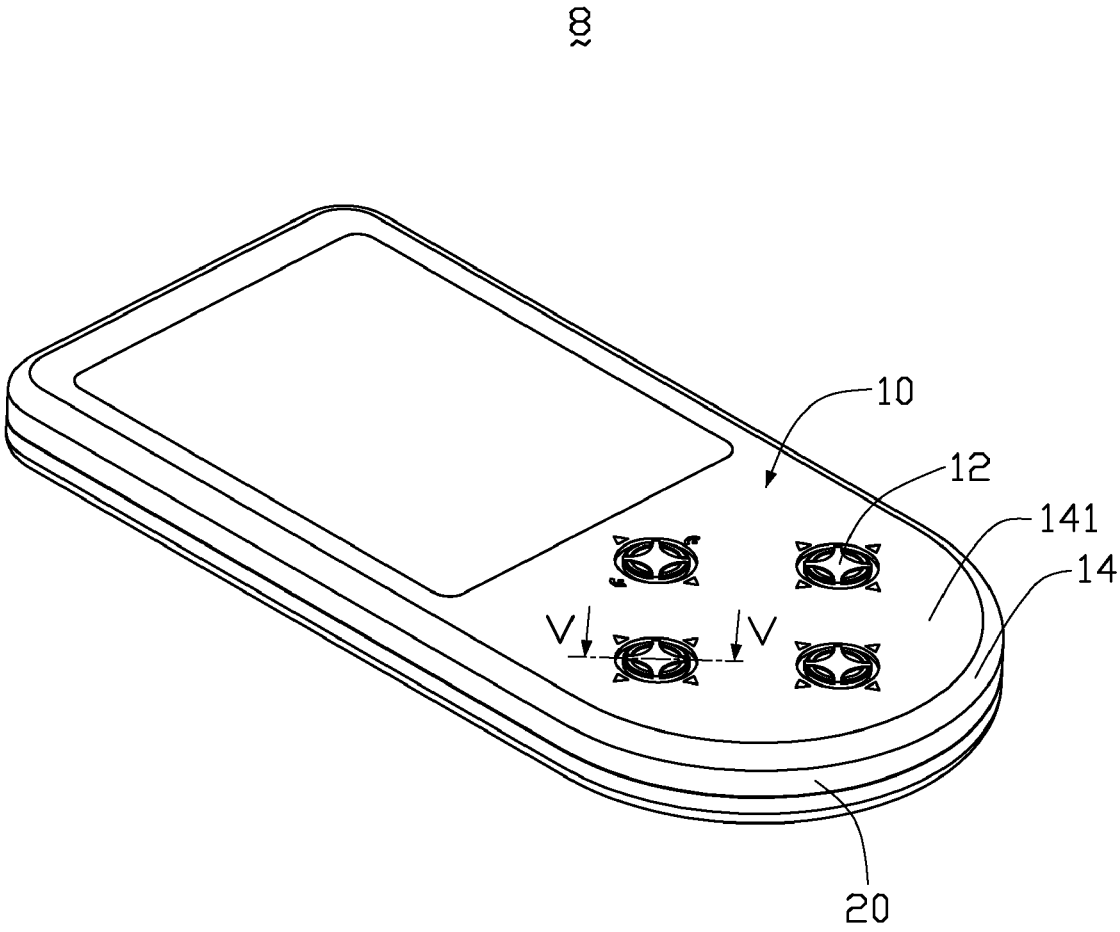
FIG. 1 is an assembled, isometric view of a portable electronic device having a keypad assembly, in accordance with a present embodiment.

Referring now to the drawings in detail, FIG. 1 shows a portable electronic device 8 employing the present keypad assembly 10. The portable electronic device 8 includes a substrate seat 20. The keypad assembly 10 is mounted on one side of the substrate seat 20.

Figure 2:
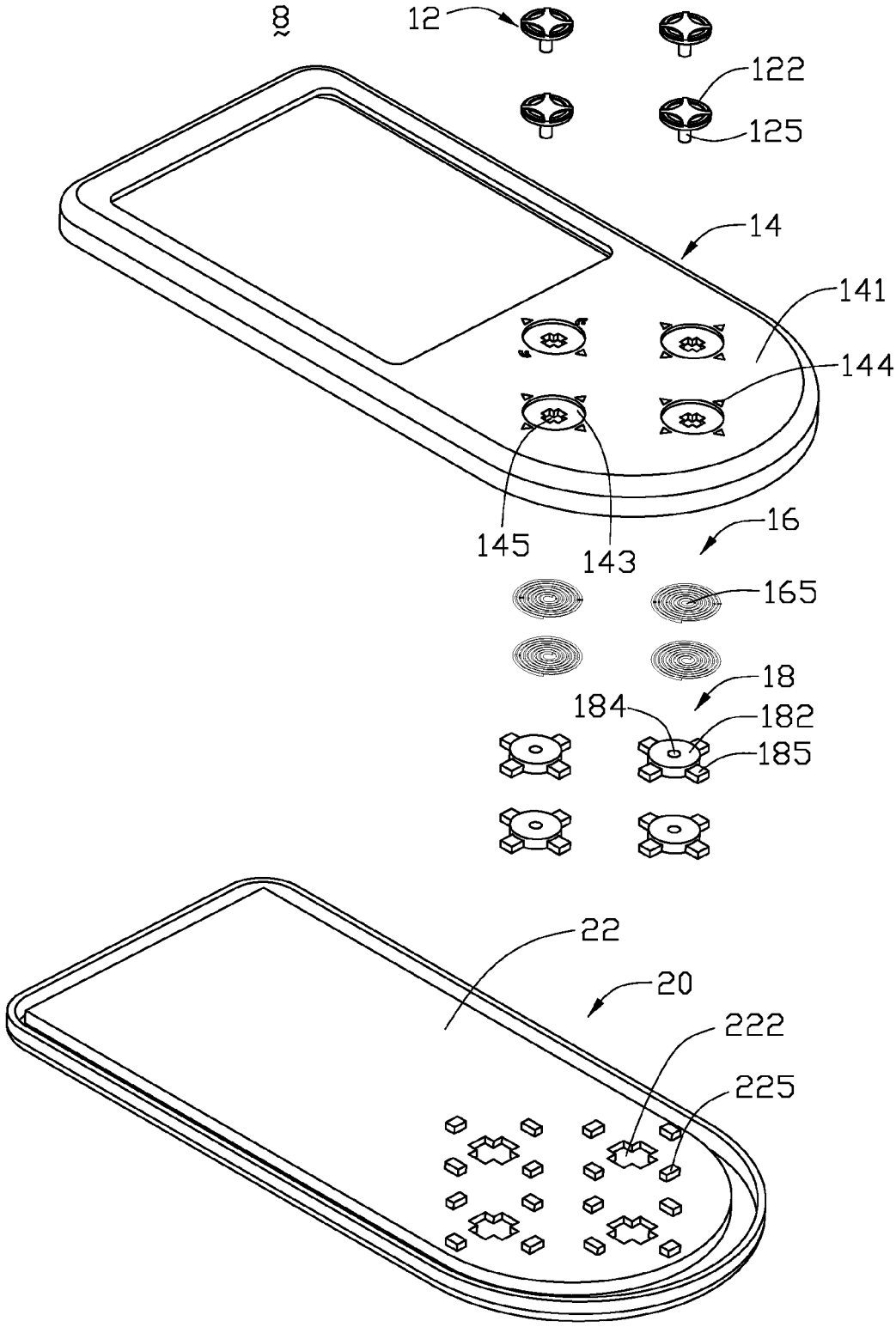
FIG. 2 is an exploded, isometric view of the portable electronic device, shown in FIG. 1.

Also referring to FIG. 2, the keypad assembly 10 includes four keys 12, a housing 14, four springs 16, and four contacts 18. The keys 12, the springs 16 and the contacts 18 are all mounted to the housing 14.

Figure 4:
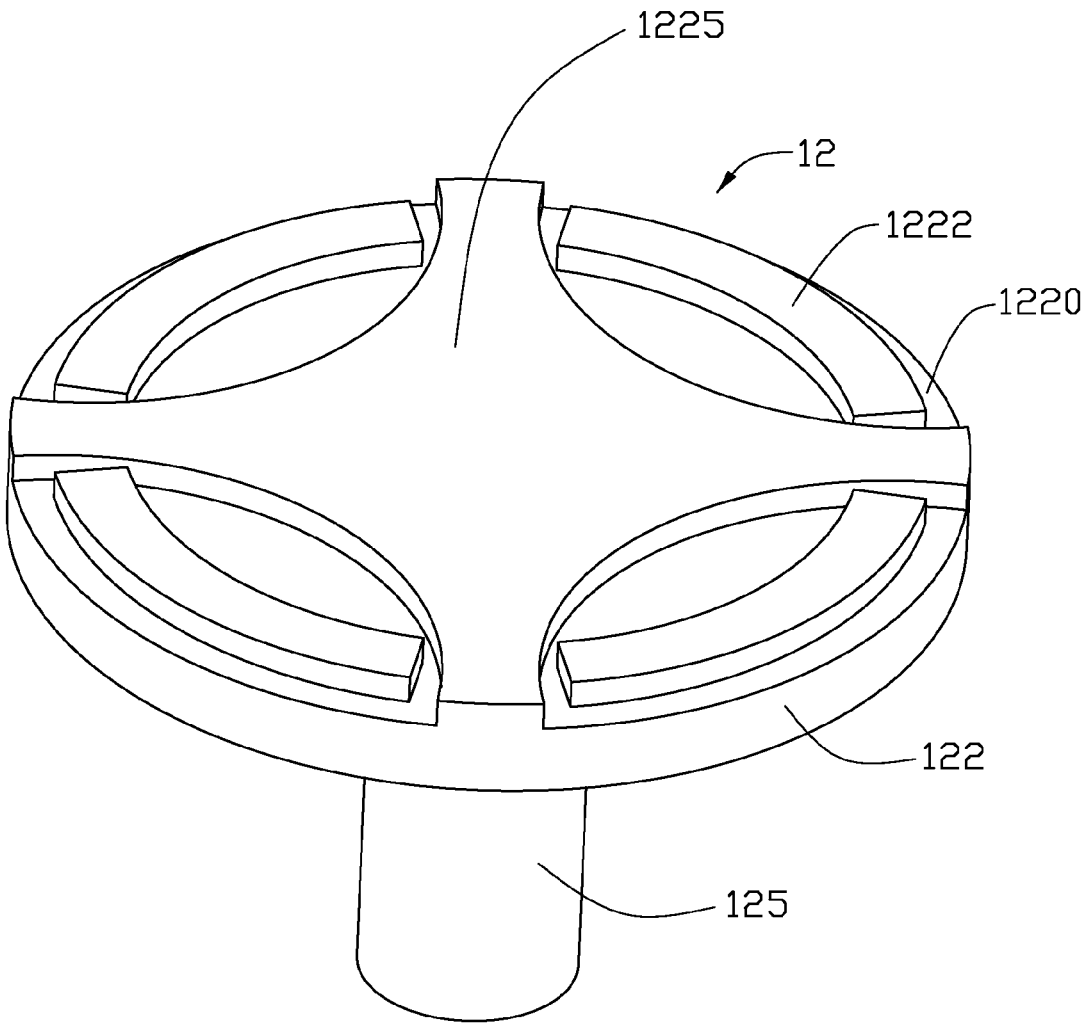
FIG. 4 is an enlarged, isometric view of the key of the keypad assembly shown in FIG. 3.

Also referring to FIG. 4, each key 12 has a key body 122 and a connection pole 125. The key body 122 is substantially disk-shaped and has an upper surface 1220. An operational protrusion 1225 is formed at a center of the upper surface 1220 with the shape similar to "+". Four distal ends of the operational protrusion 1225 all extend to an edge of the upper surface 1220. An arched protrusion 1222 is formed around the edge of the upper surface 1220, and between each pair of adjacent distal ends of the operational protrusion 1225. The operational protrusion 1225 and the arched protrusions 1222 are configured for ease of operation of the key 12. The connection pole 125 is formed on the center at the opposite side to the operational protrusion 1225 and the arched protrusions 1222.

Figure 3:
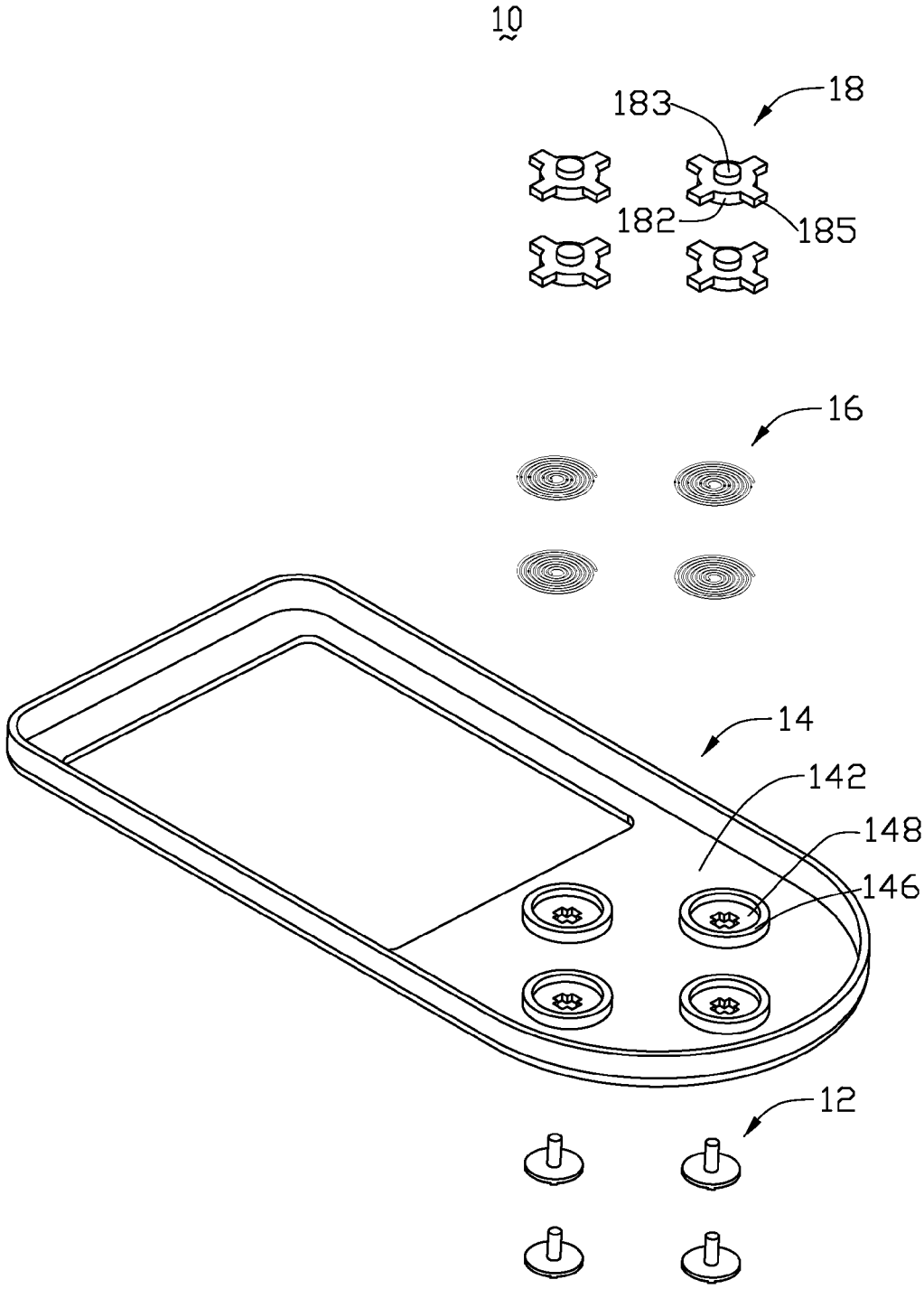
FIG. 3 is an exploded, isometric view of the keypad assembly, but viewed from another aspect, the keypad assembly having four keys.

Also referring to FIGS. 2-3, the housing 14 is generally a rectangular flat board that contains an outer surface 141 and an opposite inner surface 142. Four key recesses 143 are formed in the outer surface 141 of the housing 14. Four pole holes 145 are defined in the housing 14. Each pole hole 145 is substantially defined through a center portion of a corresponding key recess 143. Each key recess 143 communicates with a corresponding pole hole 145 and together cooperatively receive a corresponding key 12 therein. A diameter of each key body 122 is smaller than the diameter of the key recess 143 so the key body 122 is movable inside the key recess 143 in different directions substantially parallel to the outer surface 141. The pole hole 145 is substantially "+"-shaped and extends respectively in both transverse direction and longitudinal direction. The pole 125 of the key 12 is structured and arranged to be movable along the transverse direction or the longitudinal direction in the pole hole 145. Four characters 144 are distributed around each key recess 143. Each character 144 is adjacent to a corresponding distal end of the pole hole 145. Four positioning protrusions 146 are formed on the inner surface 142. Each positioning protrusion 146 is substantially shaped as a circular ring and defines a spring cavity 148 therein. Each spring cavity 148 communicates with a corresponding pole hole 145.

Each spring 16 is a disk-shaped coil spring and has a central hole 165 defined in the center thereof configured for allowing a corresponding pole 125 of the key 12 to travel therethrough. An outer diameter of each spring 16 is equal to an inner diameter of the positioning protrusion 146, so that when the spring 16 is received in the spring cavity 148, the most outer portion of the spring 16 abuts against an inner wall of the positioning protrusion 146.

Each contact 18 includes a round flat board 182, a guiding pole 183, and four feelers 185. A diameter of the round flat board 182 is smaller than the inner diameter of the positioning protrusion 146, so that the round flat board 182 is movable inside the spring cavity 148 in any direction substantially parallel to the outer surface 141 of the housing 14. The round flat board 182 defined a recess 184 in a center of one side thereof. The pole 125 of the key 12 is configured to be received in the recess 184 of the contact 18, therefore the key 12 can drive the contact 18 to move together when the key 12 to manually moved. The guiding pole 183 is formed on a side of the round flat board 182 opposite to the side defining the recess 184. The four feelers 185 are formed at a sidewall of the round flat board 182 and each feeler 185 is thinner than the round flat board 182 so that only a portion of the round flat board 182 is received in the positioning protrusion 146 while the feelers 185 are not received in the positioning protrusion 146. The distribution of the four feelers 185 is similar to that of the four characters 144 around one key recess 143. In another word, one feeler 185 corresponds to one character 144.

The substrate seat 20 includes a substrate 22. The substrate board 22 defines four guiding holes 222 therein. Each guiding hole 222 is substantially "+"-shaped. The guiding pole 183 of the contact 18 is configured for being movable along the transverse direction or the longitudinal direction in the guiding hole 222. Four switchpoints 225 are provided around each guiding hole 222. Each switchpoint 225 corresponds to a corresponding distal end of the guiding hole 222.

Figure 5:
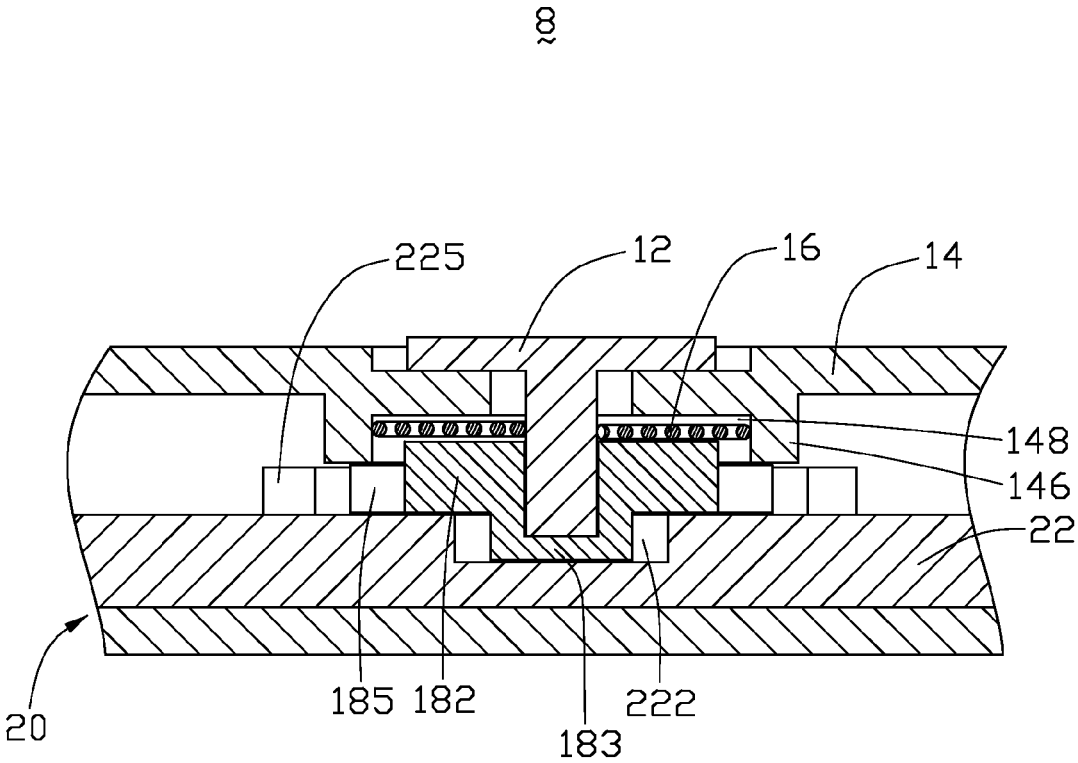
FIG. 5 is a cross-sectional view taken from line V-V of FIG. 1.

In assembly, each connection pole 125 is inserted into a corresponding pole hole 145 of the housing 14 and each key body 122 of the key 12 is movably received in a corresponding key recess 143 of the housing 14. Thus, the keys 12 are mounted to the housing 14. Each spring 16 is structured to be firmly positioned in a corresponding spring cavity 148 of the housing 14 with each connection pole 125 traveling through a corresponding central hole 165 of the spring 16. Each connection pole 125 is inserted into the recess 184 of a corresponding contact 18. The round flat board 182 is partially received in the spring cavity 148. In the present embodiment, the outer portion of each spring 16 abuts against a corresponding positioning protrusion 146 of the housing 14. Thus, the spring 16 is firmly positioned in the spring cavity 148 and the contact 18 is firmly connected to a corresponding key 12. The assembled keypad assembly 10 is mounted to the substrate board 22 of the substrate seat 20. Each guiding pole 183 is received in a corresponding guiding hole 222 of the substrate seat 20. Each feeler 185 of the contact corresponds to one character 144 of the housing 14 and one switchpoint 225. Thus, the portable electronic device 8 is completely assembled and is in an original state, as represented in FIGS. 1 and 5.

When a user wants to input any of the characters 144 by the keypad assembly 10, the user needs to select the key 12 corresponding to the target character 144. The key 14 is manually moved towards the target character 144 along a predetermined direction pointing to the target character 144. At the same time, a portion of the spring 16 adjacent to the target character 144 is compressed due to the movement of the connection pole 125 along the predetermined direction in the pole hole 145 of the housing 14. The contact 18 connected to the key 12 is also being moved towards the character 144 until the corresponding feeler 185 touches the corresponding switchpoint 225, thereby switching on a circuit of a printed circuit board (not shown) to input the target character 144. The key 12 is defined in an operational state when it is being manually moved (operated) to select a specific character. The key 12 is released and is moved to its original state, i.e. the static state, due to the decompression of the spring 16.

It is to be understood that the operational protrusion 1225 and the arched protrusions 1222 formed on the upper surface 1220 of the key 12 may be other structures and designs for ease of operation of the key 12. The spring 16 may be other elastic members, such as other leaf springs or rubber rings. The number of the keys 12, holes 143, 145, springs 16, and contacts 18 may be one, two, three, or more. It is to be understood that the number of keys 12 cannot exceed the number of the key recesses 143. The substrate board 22 may be a printed circuit board of the portable electronic device 8.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A keypad assembly comprising:

a housing having an outer surface and an inner surface, the outer surface defining a recess therein, the inner surface forming a ring positioning protrusion with an inner wall; and a key being movably received in the recess along a direction parallel to the outer surface;

an elastic member received in the ring positioning protrusion of the housing;

a contact supporting the elastic member, the key passing through the elastic member and being fixed with the contact; the key with the contact moving relative to the housing and the elastic member providing a reverse force to allow the key back to an original state.

2. The keypad assembly as claimed in claim 1, wherein the elastic member is substantially disk-shaped.

3. The keypad assembly as claimed in claim 2, wherein an outer diameter of the elastic member abuts against the inner wall of the positioning protrusion.

4. The keypad assembly as claimed in claim 1, wherein the recess defines a hole in the center thereof, the hole being substantially "+"-shaped with four distal ends, and the key has a pole portion passing through the hole and is configured for being movable along a transverse direction or along a longitudinal direction in the hole.

5. The keypad assembly as claimed in claim 4, wherein four characters are distributed around the recess on the outer surface, each character corresponds a distal end of the hole.

6. The keypad assembly as claimed in claim 1, the contact having a flat board and at least one feeler, and the at least one feeler is formed on a sidewall of the flat board, the flat board is slidably received in the positioning protrusion, and the inner wall limits a movable range of the contact.

7. The keypad assembly as claimed in claim 6, wherein the flat board is round, and an outer diameter of the flat board is smaller than an inner diameter of the positioning protrusion.

8. The keypad assembly as claimed in claim 1, wherein the key pushes the elastic member from a central direction to one side thereof so that the elastic member is compressed for forming the reverse force to allow the key back to an original state.

9. The keypad assembly as claimed in claim 8, wherein the key includes a key body and a connection pole, the connection pole passes through the elastic member, the key moves toward one side of the elastic member, and the connection pole pushes the elastic member to be compressed for allowing the key back to an original state.

10. The keypad assembly as claimed in claim 1, wherein the key has a key body, the key body forms an operational protrusion with four distal ends extending to an edge thereof, and an arched protrusion is formed between any two distal ends.

11. A portable electronic device comprising:

a keypad assembly, comprising:

a housing having an outer surface and an inner surface, the inner surface forming a ring positioning protrusion with an inner wall; and a key being movably positioned in the outer surface along a direction parallel to the outer surface;

an elastic member received in the positioning protrusion and abutting the inner wall;

a contact supporting the elastic member, the key passing through the elastic member and being fixed with the contact; and a substrate seat having at least one switchpoint, wherein the housing being mounted to the substrate seat, the key is manually operative to move from the original state to the operational state to abut against the switchpoint, and to move back from the operational state to the original state when the operation on the key is released.

12. The portable electronic device as claimed in claim 11, wherein the key with the contact moves relative to the housing and the elastic member provides a reverse force to allow the key back to an original state.

13. The portable electronic device as claimed in claim 12, wherein the key pushes the elastic member from a central direction to one side thereof so that the elastic member is compressed for forming the reverse force to allow the key back to an original state.

14. The portable electronic device as claimed in claim 11, wherein the contact has a flat board and four feelers, and each feeler is formed on a sidewall of the flat board, the flat board is slidably received in the positioning protrusion, and the inner wall limits a movable range of the contact.

* * * * *